US011766797B2

(12) United States Patent
Skrobis et al.

(10) Patent No.: US 11,766,797 B2
(45) Date of Patent: Sep. 26, 2023

(54) RAZOR BLADES HAVING A WIDE FACET ANGLE

(71) Applicant: The Gillette Company LLC, Boston, MA (US)

(72) Inventors: Kenneth James Skrobis, Maynard, MA (US); Jeffrey Stuart Parker, Quincy, MA (US); Bin Shen, Boston, MA (US); Matthew Robert Stone, Oxford, MA (US); John Joseph Nisby, Hanson, MA (US); Jason Scott Slattery, Malden, MA (US); Yongqing Ju, Boston, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/729,854

(22) Filed: Dec. 30, 2019

(65) Prior Publication Data

US 2020/0130211 A1 Apr. 30, 2020

Related U.S. Application Data

(63) Continuation of application No. 15/288,051, filed on Oct. 7, 2016, now Pat. No. 10,549,438, which is a continuation of application No. 13/419,929, filed on Mar. 14, 2012, now abandoned.

(60) Provisional application No. 61/507,710, filed on Jul. 14, 2011.

(51) Int. Cl.
*B26B 21/56* (2006.01)
*B26B 21/60* (2006.01)

(52) U.S. Cl.
CPC ..... *B26B 21/56* (2013.01); *B26B 21/60* (2013.01)

(58) Field of Classification Search
CPC ..... B26B 21/56; B26B 21/58; B26B 21/60
USPC ..... 30/346.5, 346.53–346.55, 346.58, 350, 30/357; 76/DIG. 8, 104.1
See application file for complete search history.

(56) References Cited

U.S. PATENT DOCUMENTS 3,635,811 A 1/1972 Lane
3,652,342 A 3/1972 Fischbein et al.
3,754,329 A 8/1973 Lane
(Continued)

FOREIGN PATENT DOCUMENTS

EP 0 884 142 A1 12/1998
EP 2 130 653 A1 12/2009
(Continued)

OTHER PUBLICATIONS

PCT Search Report and Written Opinion for PCT/US2012/046649 dated Oct. 18, 2012, 8 pages.

*Primary Examiner* — Jason Daniel Prone
(74) *Attorney, Agent, or Firm* — Kevin C. Johnson; Joanne N. Pappas

(57) ABSTRACT

A razor blade including a substrate with a coating joined to the substrate defining a coated blade. The coated blade including a cutting edge being defined by a blade tip having a tip radius of from 50 to 350 angstroms. The coated blade having a pair of first facets extending from the blade tip and a pair of second facets extending from the respective first facets, a facet angle from 90° to 135°, a facet width from 0.38 micrometers to 0.65 micrometers a wedge angle from 5° to 30°, and a thickness of between 0.8 and 1.5 micrometers measured at a distance of 1 micrometer from the blade tip.

11 Claims, 4 Drawing Sheets

(56) References Cited

U.S. PATENT DOCUMENTS

| | | | | |
|---|---|---|---|---|
| 3,761,372 | A | 9/1973 | Sastri | |
| 3,761,373 | A | 9/1973 | Sastri | |
| 3,761,374 | A | 9/1973 | Bromer et al. | |
| 3,802,078 | A | 4/1974 | Denes | |
| 3,811,189 | A | 5/1974 | Sastri | |
| 3,835,537 | A | 9/1974 | Sastri | |
| 3,890,109 | A | 6/1975 | Jones | |
| 3,894,337 | A | 7/1975 | Jones | |
| 3,911,579 | A | 10/1975 | Lane et al. | |
| 3,960,608 | A | 6/1976 | Cole | |
| 4,122,603 | A | 10/1978 | Sastri | |
| 4,139,942 | A | 2/1979 | Sastri et al. | |
| 4,291,463 | A | 9/1981 | Williams | |
| 4,720,918 | A | 1/1988 | Curry et al. | |
| 5,048,191 | A | 9/1991 | Hahn | |
| 5,056,227 | A | 10/1991 | Kramer | |
| 5,088,202 | A | 2/1992 | Boland et al. | |
| 5,129,289 | A | 7/1992 | Boland et al. | |
| 5,142,785 | A | 9/1992 | Grewal et al. | |
| 5,232,568 | A | 8/1993 | Parent et al. | |
| 5,263,256 | A | 11/1993 | Trankiem | |
| 5,275,672 | A | 1/1994 | Althaus et al. | |
| 5,488,774 | A | 2/1996 | Janowski | |
| 5,497,550 | A | 3/1996 | Trotta et al. | |
| 5,669,144 | A | 9/1997 | Hahn et al. | |
| 5,795,648 | A | 8/1998 | Goel et al. | |
| 5,940,975 | A | 8/1999 | Decker et al. | |
| 5,985,459 | A | 11/1999 | Kwiecien et al. | |
| 6,151,786 | A | 11/2000 | Hellstern | |
| 6,289,593 | B1 | 9/2001 | Decker et al. | |
| 6,330,750 | B1 | 12/2001 | Meckel | |
| 6,684,513 | B1 | 2/2004 | Clipstone et al. | |
| 6,962,000 | B2 | 11/2005 | Teeuw et al. | |
| 7,060,367 | B2 | 6/2006 | Yamada et al. | |
| 7,140,113 | B2 | 11/2006 | King et al. | |
| 7,587,829 | B2 | 9/2009 | King et al. | |
| 7,673,541 | B2 | 3/2010 | Skrobis et al. | |
| 7,966,909 | B2 | 6/2011 | Madeira et al. | |
| 8,769,833 | B2 * | 7/2014 | Culf | B26B 9/02 30/346.54 |
| 9,079,321 | B2 * | 7/2015 | Claus | B26B 21/60 |
| 9,248,579 | B2 * | 2/2016 | DePuydt | B26B 21/56 |
| 9,751,230 | B2 * | 9/2017 | Skrobis | B26B 21/56 |
| 10,549,438 | B2 * | 2/2020 | Skrobis | B26B 21/56 |
| 11,654,588 | B2 * | 5/2023 | Nisby et al. | B26B 21/56 30/346.54 |
| 2003/0096060 | A1 | 5/2003 | Trankiem et al. | |
| 2003/0121158 | A1 | 7/2003 | Clipstone et al. | |
| 2004/0172832 | A1 | 9/2004 | Clipstone et al. | |
| 2005/0028389 | A1 | 2/2005 | Wort et al. | |
| 2005/0126016 | A1 | 6/2005 | Branden | |
| 2006/0201001 | A1 * | 9/2006 | Teeuw | B26B 21/60 30/346.54 |
| 2006/0242844 | A1 | 11/2006 | Skrobis et al. | |
| 2006/0277767 | A1 | 12/2006 | Sun et al. | |
| 2007/0186424 | A1 | 8/2007 | Becker et al. | |
| 2010/0011590 | A1 | 1/2010 | Depuydt et al. | |
| 2010/0011595 | A1 | 1/2010 | Claus et al. | |
| 2010/0024222 | A1 | 2/2010 | Akari et al. | |
| 2010/0043232 | A1 | 2/2010 | Skrobis et al. | |
| 2010/0287781 | A1 | 11/2010 | Skrobis | |
| 2010/0299931 | A1 | 12/2010 | Marchev et al. | |
| 2013/0014395 | A1 | 1/2013 | Patel et al. | |
| 2013/0014396 | A1 | 1/2013 | Skrobis et al. | |
| 2013/0031794 | A1 | 2/2013 | Duff, Jr. et al. | |
| 2015/0328789 | A1 | 11/2015 | Skrobis et al. | |
| 2017/0136640 | A1 * | 5/2017 | Skrobis | B26B 21/58 |
| 2017/0348867 | A1 * | 12/2017 | Papatriantafyllou | B26B 21/56 |
| 2018/0043561 | A1 * | 2/2018 | Nisby | B26B 21/60 |
| 2018/0215056 | A1 * | 8/2018 | Logothetidis | B26B 21/60 |
| 2020/0307006 | A1 * | 10/2020 | Kontokostas | B26B 21/56 |
| 2020/0368928 | A1 * | 11/2020 | Park | B26B 21/60 |
| 2020/0368929 | A1 * | 11/2020 | Park | B26B 21/60 |
| 2021/0031388 | A1 * | 2/2021 | Xu | B26B 21/60 |
| 2021/0031390 | A1 * | 2/2021 | Skrobis | B26B 21/56 |
| 2021/0094199 | A1 * | 4/2021 | Lee | B26B 21/60 |
| 2021/0162615 | A1 * | 6/2021 | Siozios | B26B 21/60 |
| 2021/0162616 | A1 * | 6/2021 | Logothetidis | B26B 21/60 |
| 2021/0221014 | A1 * | 7/2021 | Mavroeidis | B26B 21/60 |

FOREIGN PATENT DOCUMENTS

| | | | |
|---|---|---|---|
| GB | 1 350 594 | A | 4/1974 |
| WO | 9300204 | A1 | 1/1993 |

* cited by examiner

RAZOR BLADES HAVING A WIDE FACET ANGLE

CROSS REFERENCE TO RELATED APPLICATION

This application is a Continuation of U.S. application Ser. No. 15/288,051, now U.S. Pat. Nos. 10,549,438, and 13,419,929 filed Mar. 14, 2012, which has a provisional 61/507,710, incorporated by reference herein.

FIELD OF THE INVENTION

This invention relates to razors and more particularly to razor blades with sharp and durable cutting edges having a large forward profile near the tip and a narrow profile further away from the tip.

BACKGROUND OF THE INVENTION

A razor blade is typically formed of a suitable substrate material such as stainless steel, and a cutting edge is formed with a wedge-shaped configuration with an ultimate tip having a radius. Hard coatings such as diamond, amorphous diamond, diamond-like carbon-(DLC) material, nitrides, carbides, oxides, or ceramics are often used to improve strength, corrosion resistance, and shaving ability, maintaining needed strength while permitting thinner edges with lower cutting forces to be used. Polytetrafluoroethylene (PTFE) can be used to provide friction reduction. Layers of niobium or chromium containing materials can aid in improving the binding between the substrate, typically stainless steel, and hard carbon coatings, such as DLC.

It is desirable to alter the shape of the razor blade to achieve a razor blade with a low cutting force, while at the same time improving safety and comfort. By finding the ideal edge design it is possible to provide a low cutting force blade that is safer on the skin leading to a more comfortable shave.

Prior blades improved shaving comfort by reductions in tip radii and overall profile cross-section, reducing the tug-and-pull associated with cutting through hair. These sharper edges however required special implementation to avoid discomfort associated with the blade-skin interactions. Also, as a consequence of thinning the blade bevel profile, strength and durability can be compromised.

The present invention addresses the problems of balancing the desire for low cutting force, increased safety, and increased comfort. The present invention provides a blade tip having a wider forward profile near the blade tip with a small tip radius while maintaining a narrow profile away from the blade tip.

The large forward profile near the tip in conjunction with a narrow blade profile further away from the tip provides a low cutting force blade edge that has less propensity to engage the skin allowing the skin to glide over the edge without nicking, cutting or scraping. Such a blade reduces irritation and increases comfort.

SUMMARY OF THE INVENTION

The present invention provides a razor blade comprising a substrate with a coating joined to the substrate defining a coated blade. The coated blade has a cutting edge being defined by a blade tip having a tip radius of from 50 to 350 angstroms, preferably from 100 to 300 angstroms. The coated blade comprises a pair of first facets extending from the blade tip and a pair of second facets extending from respective first facets. The coated blade comprises a facet angle from 90° to 135°, a facet width from 0.38 micrometers to 0.65 micrometers a wedge angle from 5° to 30°. The coated blade has a thickness of between 0.8 and 1.5 micrometers measured at a distance of 1 micrometer from the blade tip.

Preferably, the coated blade has a thickness of between 1.1 and 1.7 micrometers measured at a distance of 2 micrometers from the blade tip. Preferably, the coated blade has a thickness of between 1.6 and 2.1 micrometers measured at a distance of 4 micrometers from the blade tip. Preferably, the coated blade has a thickness of between 0.38 and 0.67 micrometers measured at a distance of 0.25 micrometers from the blade tip. Preferably, the coated blade has a thickness of between 0.55 and 0.95 micrometers measured at a distance of 0.5 micrometers from the blade tip. Preferably, the coated blade has a thickness of between 2.66 and 3.16 micrometers measured at a distance of 8 micrometers from the blade tip. Preferably, the coated blade a thickness of between 4.06 and 5.06 micrometers measured at a distance of 16 micrometers from the blade tip.

Preferably, the substrate is a martensitic stainless steel having a carbide density of from 200 to 1000 carbides per 100 square micrometers as determined by optical microscopic cross-section.

The coating may comprise an adhesive layer joined to the substrate. The adhesive layer may comprise niobium.

The coating may comprise a hard coating layer joined to the adhesive layer. The hard coating layer may comprise an amorphous material containing carbon.

The coating may comprise an overcoat layer joined to said hard coating layer. The overcoat layer may comprise chromium.

A lubricious material may be applied to the overcoat layer. The lubricious material may comprise a polymer. The lubricious material may comprise polytetrafluoroethylene.

BRIEF DESCRIPTION OF DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
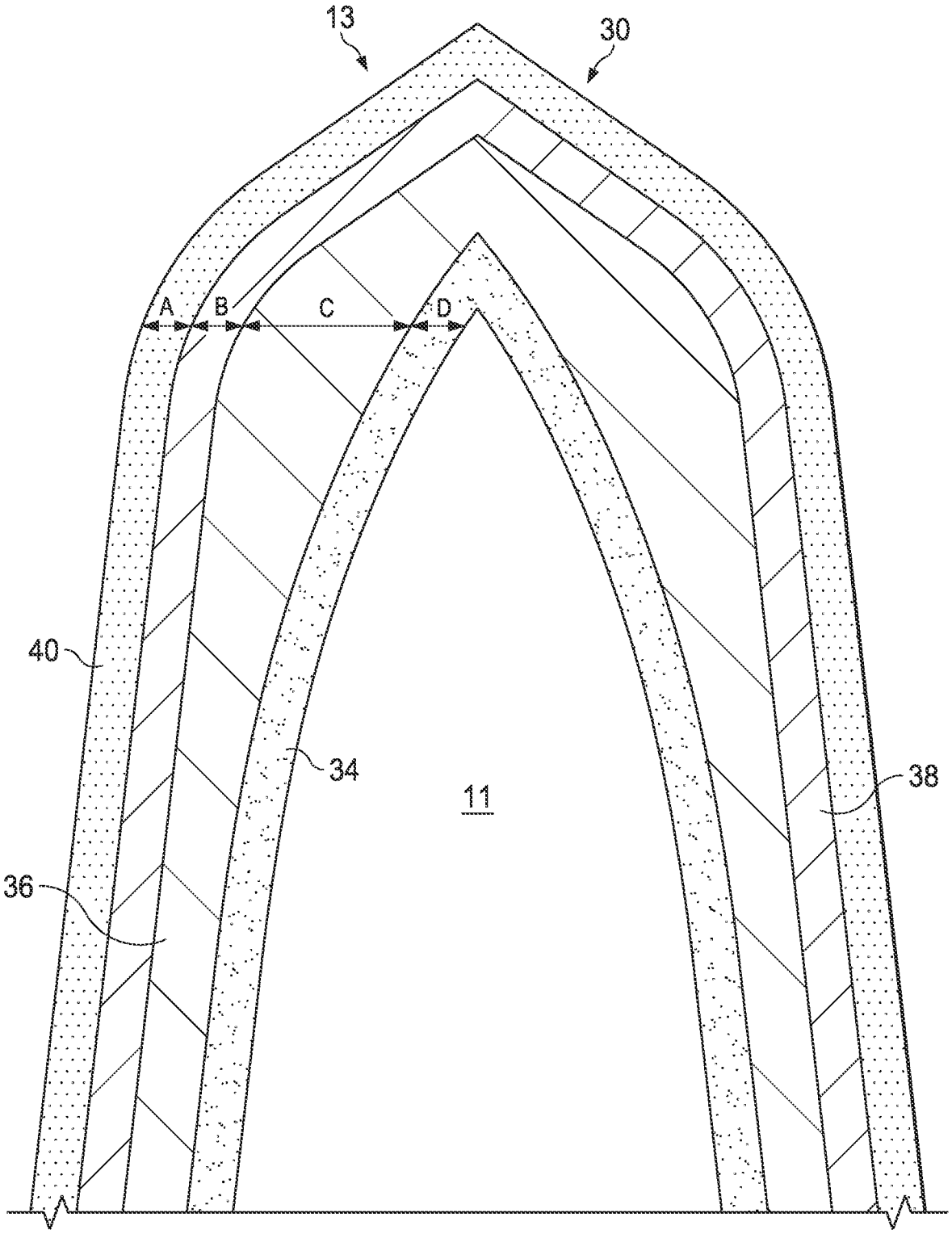
FIG. 1 is a diagrammatic view illustrating a razor blade of the present invention.
Figure 2:
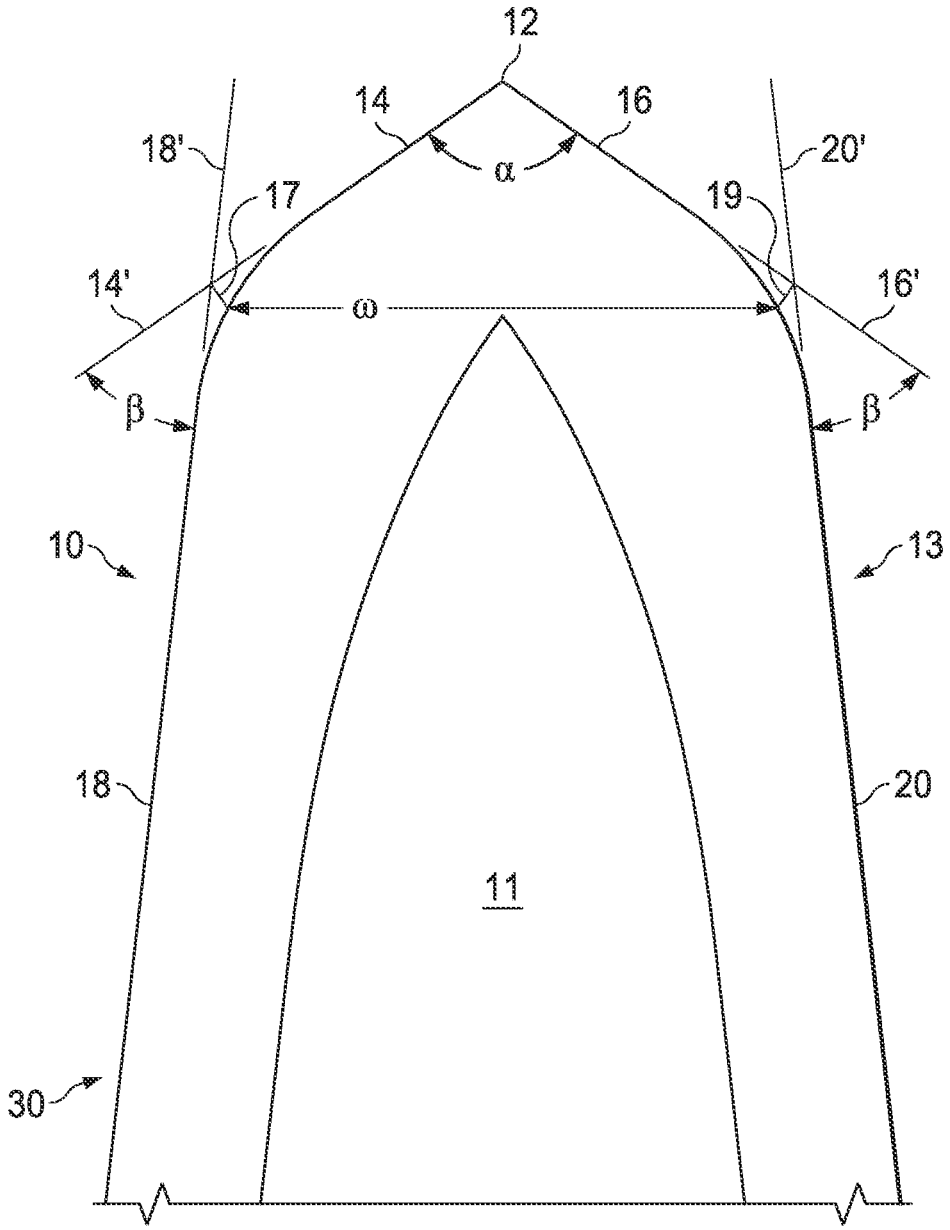
FIG. 2 is a diagrammatic view of the razor blade of FIG. 1
Figure 3:
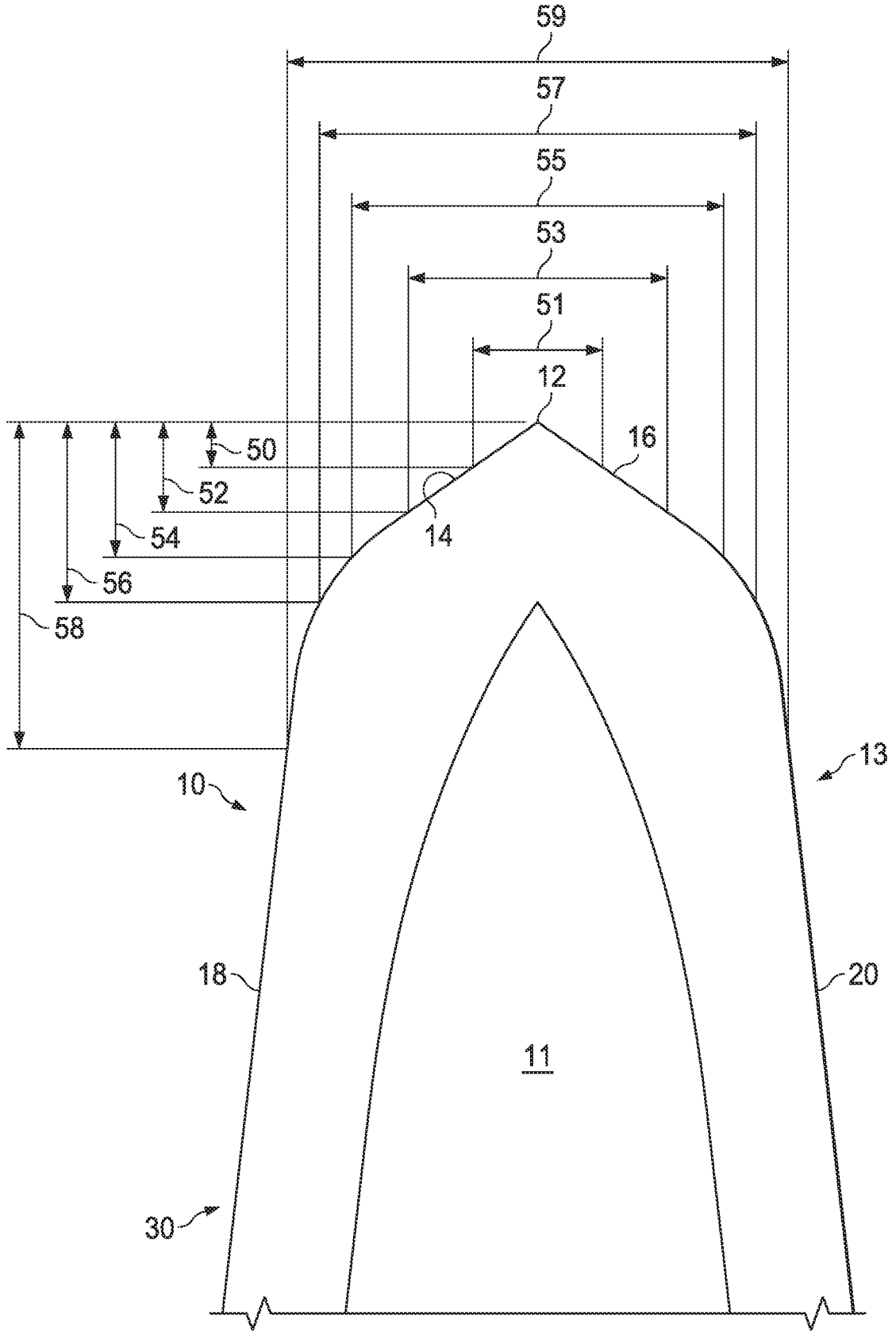
FIG. 3 is a diagrammatic view of the razor blade of FIG. 1.

Referring now to FIGS. 1-3, there is shown a razor blade 10 including substrate 11 with a coating 30 joined to the substrate 11 resulting in a coated blade 13. The coating 30 may include one or more layers. The coating 30 shown includes adhesive layer 34, hard coating layer 36, and overcoat layer 38. The substrate 11 is typically made of stainless steel though other materials can be employed.

Adhesive layer 34 is used to facilitate bonding of the hard coating layer 36 to the substrate 11. Examples of suitable adhesive layer materials are niobium, titanium, and chromium containing material. The adhesive layer may have a thickness from 100 angstroms to 500 angstroms. A particular adhesive layer is made of niobium having a thickness from 150 angstroms to 350 angstroms. PCT 92/03330 describes use of a niobium as an adhesive layer.

Hard coating layer or layers 36 provides improved strength, corrosion resistance and shaving ability and can be made from fine-, micro-, or nano-crystalline carbon-containing materials (e.g., diamond, amorphous diamond or DLC), nitrides (e.g., boron nitride, niobium nitride, chromium nitride, zirconium nitride, or titanium nitride), carbides (e.g., silicon carbide), oxides (e.g., alumina, zirconia), other ceramic materials (including nanolayers or nanocomposites), metals or metal alloys. The carbon containing materials can be doped with other elements, such as tungsten, titanium, silver, or chromium by including these additives, for example in the target during application by sputtering. The materials can also incorporate hydrogen, e.g., hydrogenated DLC. Preferably hard coating layer 36 is made of diamond, amorphous diamond, or DLC. A particular embodiment includes DLC less than 5,000 angstroms, preferably from 300 angstroms to 3,000 angstroms. DLC layers and methods of deposition are described in U.S. Pat. No. 5,232,568. As described in the "Handbook of Physical Vapor Deposition (PVD) Processing, "DLC is an amorphous carbon material that exhibits many of the desirable properties of diamond but does not have the crystalline structure of diamond."

Overcoat layer 38 may be used to facilitate bonding of a lubricious material to the hard coating. Overcoat layer 38 is preferably made of chromium containing material, e.g., chromium or chromium alloys or chromium compounds that are compatible with polytetrafluoroethylene, e.g., CrPt. A particular overcoat layer is chromium 100-200 angstroms thick. Overcoat layer may have a thickness of from 50 angstroms to 500 angstroms, preferably from 100 angstroms to 300 angstroms. Other materials may be used for overcoat layer 38 to facilitate adhesion of particular lubricious materials.

Lubricious material 40 may be used to provide reduced friction. The thickness of the lubricious material 40 is of course ignored for the purposes of calculating the dimensions of the coated blade 13. The lubricious material 40 may be a polymer composition or a modified polymer composition. The polymer composition may be polyfluorocarbon. A suitable polyflourocarbon is polytetrafluoroethylene sometimes referred to as a telomer. A particular polytetrafluoroethylene material is DUPONT® Krytox LW 2120 available from DuPont. This material is a nonflammable and stable dry lubricant that consists of small particles that yield stable dispersions. It is furnished as an aqueous dispersion of about 20% solids by weight and can be applied by dipping, spraying, or brushing, and can thereafter be air dried or melt coated. The lubricious material is preferably less than 5,000 angstroms thick and could typically be 1,500 angstroms to 4,000 angstroms thick, and can be as thin as 100 angstroms, provided that a continuous coating is maintained. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

The coated blade 13 includes a wedge-shaped sharpened edge having a blade tip 12 with first facets 14 and 16 that extend from blade tip 12. First facets 14 and 16 diverge as they extend from blade tip 12. Second facets 18 and 20 extend from first facets 14 and 16, respectively. Coated blade 13 has a facet angle $\alpha$ between first facets 14 and 16. Facet angle $\alpha$ ranges from 90° to 135°. Wedge angle $\beta$ lies between the linear extension 14' of facet 14 and second facet 18, and linear extension 16' of facet 16 and second facet 20. The two wedge angles $\beta$ will preferably be similar in degree if not identical. The wedge angles $\beta$ ranges from 5° to 30°.

A line 17 perpendicular to linear extension 14' is drawn at the intersection of linear extension 14' and linear extension 18' of second facet 18. A line 19 perpendicular to linear extension 16' is drawn at the intersection of linear extension 16' and linear extension 20' of second facet 20. Facet width w is measured between the intersection of line 17 and coated blade 13 and the intersection of line 19 and coated blade 13. Coated blade 13 has a facet width between 0.38 and 0.65 micrometers.

Figure 4:
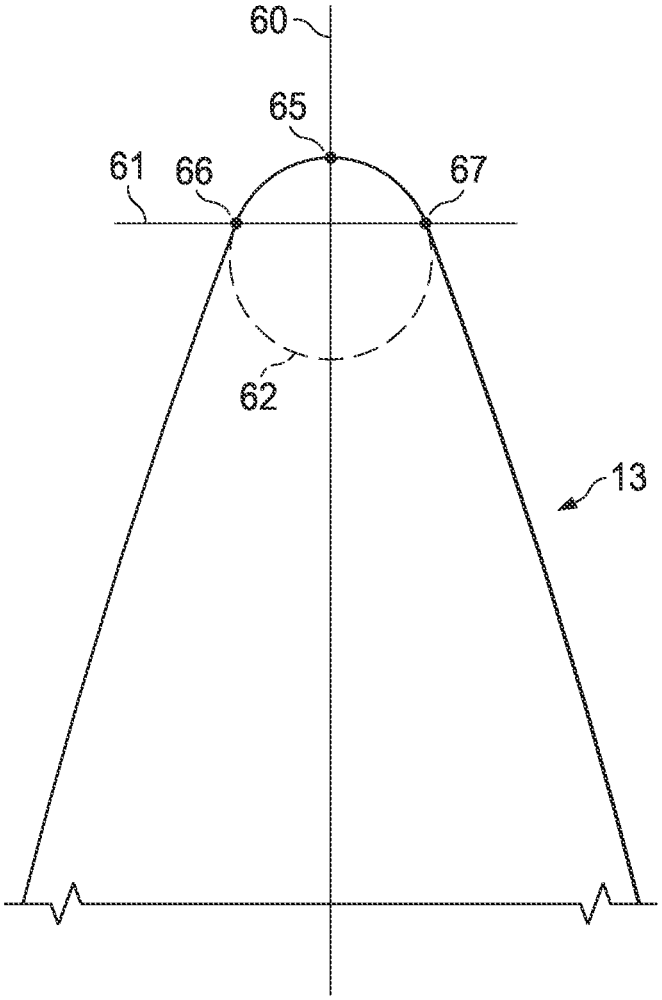
FIG. 4 is a view of a coated razor blade illustrating the method for determining the tip radius of the coated blade

Blade tip 12 preferably has a radius of from 50 to 350 angstroms. Blade tip preferably has a tip radius of from 100 to 300 angstroms. Referring now to FIG. 4 the tip radius is determined by first drawing a line 60 bisecting the coated blade 13 in half. Where line 60 bisects coated blade 13 a first point 65 is drawn. A second line 61 is drawn perpendicular to line 60 at a distance of 75 angstroms from point 65. Where line 61 bisects coated blade 13 two additional points 66 and 67 are drawn. A circle 62 is then constructed from points 65, 66 and 67. The radius of circle 62 is the tip radius for coated blade 13.

Referring now to FIGS. 1-3, the coated blade 13 has a thickness 55 of between 0.8 and 1.5 micrometers measured at a distance 54 of 1 micrometer from the blade tip 12.

Preferably, the coated blade 13 has a thickness 57 of between 1.1 and 1.7 micrometers measured at a distance 56 of 2 micrometers from the blade tip 12. Preferably, the coated blade 13 has a thickness 59 of between 1.6 and 2.1 micrometers measured at a distance 58 of 4 micrometers from the blade tip 12. Preferably, the coated blade 13 has a thickness 51 of between 0.38 and 0.67 micrometers measured at a distance 50 of 0.25 micrometers from the blade tip 12. Preferably, the coated blade 13 has a thickness 53 of between 0.55 and 0.95 micrometers measured at a distance 52 of 0.5 micrometers from the blade tip 12. As can be seen in FIG. 1, the hard coating layer 36 has a thickness C, that is larger than thicknesses A, B, and D of coatings, 40, 38, or 34 respectively. While thickness C varies as shown, thicknesses A, B, and D are each smaller (e.g., thinner) than thickness C, are uniform, and are nearly identical in thickness to each other when measured at a same distance from the blade tip 12. It follows that, where FIG. 3 depicts the coated blade 13 of FIG. 1, it is the hard coating layer 36 that contributes the most to the wider profile or thickness of coated blade 13, particularly near an upper portion of the blade 13 (e.g., less than 4 micrometers from the blade tip 12). Thus, taking FIGS. 1 and 3 together, in the region from the distance 56 of 2 micrometers from the blade tip to a distance 58 of 4 micrometers from the blade tip 12, the hard coating 36 has a thickness C which represents the largest thickness of the hard coating material throughout the coated blade and is larger than a thickness of any other material thicknesses taken at the same distances."

Preferably, the coated blade 13 maintains a narrow profile further from the blade tip 12. The coated blade 13 preferably, has a thickness of between 2.66 and 3.16 micrometers measured at a distance of 8 micrometers from the blade tip 12. The coated blade 13 preferably has a thickness of between 4.06 and 5.06 micrometers measured at a distance of 16 micrometers from the blade tip 12.

The thicknesses provide a framework for improved shaving. The thicknesses provide a balance between edge strength and low cutting force or sharpness. A blade having smaller thicknesses will have lower strength possibly leading to ultimate edge failure if the strength is too low. A blade having greater thicknesses will have a higher cutting force leading to an increased tug and pull and increased discomfort for the user during shaving.

One substrate 11 material which may facilitate producing an appropriately sharpened edge is a martensitic stainless steel with smaller more finely distributed carbides, but with similar overall carbon weight percent. A fine carbide substrate provides for a harder and more brittle after-hardening substrates, and enables the making of a thinner, stronger edge. An example of such a substrate material is a martensitic stainless steel with a finer average carbide size with a carbide density of 200, 300, 400 carbides per 100 square micrometers, to 600, 800, 1000 carbides or more per 100 square micrometers as determined by optical microscopic cross-section.

Razor blade 10 is made generally according to the processes described in the above referenced patents. A particular embodiment includes a niobium adhesive layer 34, DLC hard coating layer 36, chromium overcoat layer 38, and Krytox LW 2120 polytetrafluoroethylene lubricious material 40. Chromium overcoat layer 38 is deposited to a minimum of 100 angstroms and a maximum of 500 angstroms. It is deposited by sputtering using a DC bias (more negative than −50 volts and preferably more negative than −200 volts) and pressure of about 2 millitorr argon.

The blade tip radius and facet profile of the present invention provides an improvement in blade sharpness, safety, and shaving comfort. The razor blade 10 addresses the problems of balancing the desire for low cutting force, increased safety, and increased comfort. The blade tip has a large forward profile near the tip while maintaining a narrow profile away from the blade tip. The large forward profile near the tip in conjunction with the narrow blade profile away from the tip provides a low cutting force blade edge that has lower propensity to engage the skin allowing the skin to glide over the edge without nicking, cutting or scraping. The small tip radius maintains efficiency, the wide forward profile increases safety and comfort and the narrow profile away from the tip reduces pulling on the hair. Such a blade reduces irritation and increases comfort.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade comprising: a substrate with a coating joined to said substrate defining a coated blade, said coated blade comprising a cutting edge being defined by a blade tip, said coated blade having a blade thickness measured within a region at a distance from 2 micrometers to a distance of 4 micrometers from the blade tip, wherein said coating comprises a plurality of materials, one of said materials having a material thickness greater than any other one of said plurality of materials in said region, and wherein said blade thickness is greatest at a distance of 2 micrometers from the blade tip, 3 micrometers from the blade tip, or 4 micrometers from the blade tip.

2. The razor blade of claim 1 wherein said one of said materials comprises a hard coating material.

3. The razor blade of claim 1 wherein said one of said materials comprises a carbon containing material.

4. The razor blade of claim 3, wherein said carbon containing material comprises diamond-like carbon.

5. The razor blade of claim 1 wherein a shape of said substrate and a shape of said coating are different.

6. The razor blade of claim 1, wherein said material thickness is greatest at said distance of 2 micrometers from the blade tip, 3 micrometers from the blade tip, or 4 micrometers from the blade tip.

7. The razor blade of claim 1 wherein said blade thickness is between 1.6 and 2.1 micrometers measured at a distance of 4 micrometers from the blade tip.

8. The razor blade of claim 1, wherein said blade thickness is between 0.38 and 0.67 micrometers measured at a distance of 0.25 micrometers from the blade tip.

9. The razor blade of claim 1, wherein said blade thickness is between 0.55 and 0.95 micrometers measured at a distance of 0.5 micrometers from the blade tip.

10. The razor blade of claim 1, wherein said blade thickness is between 1.1 and 1.7 micrometers measured at a distance of 2 micrometers from the blade tip.

11. The razor blade of claim 1, wherein said blade thickness is between 0.8 and 1.5 micrometers measured at a distance of 1 micrometer from the blade tip.

* * * * *